US012774566B2

(12) United States Patent
Carrara

(10) Patent No.: US 12,774,566 B2
(45) Date of Patent: Oct. 27, 2026

(54) ANTIVIRAL AND ANTIBACTERIAL COMPOSITION AND TISSUE PRODUCT, AND RELATED MANUFACTURING METHOD

(71) Applicant: Cartiere Carrara S.p.A., Florence (IT)

(72) Inventor: Massimo Carrara, Pistoia (IT)

( * ) Notice: Subject to any disclaimer, the term of this patent is extended or adjusted under 35 U.S.C. 154(b) by 191 days.

(21) Appl. No.: 18/972,899

(22) Filed: Dec. 7, 2024

(65) Prior Publication Data

US 2025/0129548 A1 Apr. 24, 2025

(30) Foreign Application Priority Data

Oct. 11, 2023 (IT) ..... 102023000021111
Oct. 10, 2024 (EP) ..... 24205803

(51) Int. Cl.

| | |
|---|---|
| ***D21H 21/36*** | (2006.01) |
| ***D21H 17/66*** | (2006.01) |
| ***D21H 25/02*** | (2006.01) |
| ***D21H 27/00*** | (2006.01) |

(52) U.S. Cl.
CPC ..... *D21H 21/36* (2013.01); *D21H 17/66* (2013.01); *D21H 25/02* (2013.01); *D21H 27/002* (2013.01)

(58) Field of Classification Search
CPC ..... D21H 21/36; D21H 25/02; D21H 27/002; D21H 17/16
See application file for complete search history.

(56) References Cited

U.S. PATENT DOCUMENTS

| | | | | |
|---|---|---|---|---|
| 1,947,451 | A | 2/1934 | Barber | |
| 2004/0167483 | A1 | 8/2004 | Gabbay | |
| 2014/0271757 | A1* | 9/2014 | Agrawal | C09D 5/14 507/90 |
| 2020/0359633 | A1 | 11/2020 | Takino | |

FOREIGN PATENT DOCUMENTS

| | | | | |
|---|---|---|---|---|
| CA | 2624110 C | * | 11/2010 | A61K 31/4468 |
| EP | 1608810 | | 1/2007 | |
| JP | 2017133137 | | 8/2017 | |
| WO | 0129315 | | 4/2001 | |
| WO | WO-2012083082 A1 | * | 6/2012 | C09K 13/06 |
| WO | 2012162557 | | 11/2012 | |

OTHER PUBLICATIONS

English abstract CN105432522A, 2016. (Year: 2016).*
Bakirova B.S, Smagulova I.A, Akbayeva D.N. Synthesis and characterization of copper (II) chloride complexes with non-ionic polymers PEG and PVP. Chem. J. Kaz., 2022, 2(78), 142-152. (Year: 2022).*
Italian Patent and Trademark Office, Search Report, Apr. 16, 2024.

* cited by examiner

*Primary Examiner* — Anthony Calandra
(74) *Attorney, Agent, or Firm* — Themis Law

(57) ABSTRACT

A composition, and related method, adapted for making a tissue product with antiviral and antibacterial properties includes water-soluble copper metal ions with an oxidation state of +2 (II), polyethylene glycol (PEG), and polyvinylpyrrolidone (PVP).

13 Claims, 7 Drawing Sheets

ANTIVIRAL AND ANTIBACTERIAL COMPOSITION AND TISSUE PRODUCT, AND RELATED MANUFACTURING METHOD

FIELD OF THE INVENTION

The present invention refers to a tissue product, preferably made of disposable paper, with antiviral and antibacterial properties, and to a method for the manufacture thereof. An object of the present invention is also a composition for making said product. In particular, the present invention relates to a thin tissue paper or textile paper comprising water-soluble metal ions with antiviral and antibacterial properties and to a method for the manufacture thereof.

BACKGROUND OF THE INVENTION

The importance of having a single-use paper product, such as paper towels or rolls, with a low viral and bacterial load in community areas such as bathrooms or doctors' offices is well known.

According to the known technique, these products are obtained from a cellulose pulp, which is transformed into a semi-finished product (jumbo reel) used, in the production plants, to produce single-ply or multi-ply paper such as toilet paper, medical sheets, kitchen towels, handkerchiefs, bathroom towels, facial tissue, tablecloths, napkins or similar.

Maintaining a low or zero viral and bacterial load on users' hands is not solved by the dispensers of antibacterial and disinfectant products and especially by single-use handkerchiefs since the virus and the bacteria can persist for several days on the paper.

In addition, their use over time or an incorrect disposal of the paper product can re-transmit viral and bacterial particles, maintaining a high viral and bacterial load in the user him/herself (re-infection).

Copper is known to have antiviral, antibacterial and antifungal properties.

Document EP 1608810 describes a paper product made from copper-soaked fibers obtained by wetting the fibers with a solution of a reducing agent and then with the active ion (e.g. $Cu^{++}$) being reduced to its metallic form. The metal-coated fibers are then added to other untreated fibers making an active paper.

Document U.S. Pat. No. 1,947,451 describes a cellulose pulp treated with sodium orthophenyl phenate and then with copper sulfate, from which a precipitate is obtained that is incorporated into the fibers.

Document WO 2012/162557 describes a composition having antimicrobial activity comprising at least one inorganic copper salt; and at least one functionalizing agent in contact with the particles comprising said at least one inorganic copper salt, which agent by stabilizing the particles in a vehicle allows an antimicrobially effective amount of ions to be released into the environment where microbes are present.

Document WO 01/29315 describes an antiviral thin tissue paper comprising pyrrolidone carboxylic acid as an antiviral agent.

SUMMARY OF THE INVENTION

In light of the above, the main object of the present invention is to provide a tissue product, preferably a paper product such as thin tissue paper or textile paper, a paper towel, a handkerchief or a sheet for medical use, which has an immediate antiviral and antibacterial effect and which inherently has a low viral and bacterial load, which can therefore be used in common areas to clean, dry or rest body parts.

Preferably, the product subject-matter of the present invention is single-use.

A further object of the present invention is to provide a composition to be applied to a fibrous substrate and an antiviral and antibacterial tissue product in which the active agent does not create skin irritation and burning and can therefore be placed on the outer layers of the product and can thus be easily transferred directly to the skin without the antiviral and antibacterial agent having to be confined to the inner layers of the tissue.

A further object of the present invention is to provide a rapid and inexpensive method for the manufacture of an antiviral and antibacterial tissue product.

The objects of the present invention are achieved by means of a composition, a product and a method according to the attached claims.

The product comprises one or more fibrous layers and is treated with an antiviral and antibacterial composition.

The antiviral and antibacterial composition comprises at least water-soluble copper (II) ions and at least one polyethylene glycol (PEG) as a viscosifying agent, i.e. a chemical compound adapted to optimize the viscosity of the solution to allow optimal distribution on at least one fibrous layer used to make a tissue product, and comprises polyvinylpyrrolidone (PVP) as a stabilizing agent of the mixture.

Copper (II) is soluble and stable over time, unlike copper (0).

Copper salts are preferably used, which include but are not limited to copper sulfate.

For example, copper chloride, copper nitrate, copper acetate, copper bromide, copper iodide, copper gluconate and mixtures thereof may be used.

Advantageously, copper makes it possible to obtain a composition and thus a product with high antiviral and antibacterial properties that is less expensive than silver-based compositions and products.

The mixture of one or more PEGs enables the interaction between viral and/or bacterial particles and copper (II).

When active copper ions are added to the paper substrate, of the type thin tissue paper or tissue paper, these water-soluble metal ions have the ability to kill certain strains of viruses and Gram-positive and Gram-negative bacteria that come into contact with the tissue.

The antiviral and antibacterial composition subject-matter of the present invention is effective in killing certain strains of viruses such as influenza virus, rhinovirus, human coronavirus NL63, feline calicivirus, and certain strains of bacteria such as *Staphylococcus aureus* and *Klebsiella pneumoniae* and furthermore being less acidic than virucides known in the state of the art (pH in the range of 3-5 which is closer to the pH of human skin) ensures that the product subject-matter of the present invention is gentle on the skin.

An object of the present invention is also a composition suitable for use for making tissue products, in particular single- or multi-ply paper products for use in contact with parts of the user's body.

An object of the present invention is also a production method in which the antiviral and antibacterial composition can be applied during each stage of production by means of a spray or so-called coating system at room temperature.

Preferably, the antiviral and antibacterial composition is applied to the fibrous substrate as the last step in the production process so that it can be chosen between making a product with or without antiviral and antibacterial properties.

Obviously, this entails an advantage over the known methods which provide for a treatment on the pulp or on the jumbo reel, with which methods it is therefore obligatory to change the raw material used if it is wished to switch from making a product with antiviral and antibacterial properties to one without them and vice versa.

Thanks to the present invention, the antiviral and antibacterial properties are obtained without having to soak the fibers into a solution with copper and without the use of a reducing agent, because the Cu++ ions are by themselves sufficient, with PEG as an adjuvant, and PVP, for the antiviral action; furthermore, the copper solution can be applied at any production stage and not only at the pulp stage, giving the invention the best production flexibility.

Advantageously, the product subject-matter of the present invention has simultaneously antiviral and antibacterial properties: thanks to the composition subject-matter of the present invention, the active substance with both properties retains its original properties after being added to a tissue product. The uniqueness of the product subject-matter of the present invention lies in the fact that it is endowed simultaneously with antiviral and antibacterial properties and that these properties are uniformly distributed over its surface, i.e., over the surface of the tissue product treated with the composition subject-matter of the invention.

Further characteristics of the preferred embodiments of the paper product and method for the production thereof according to the present invention are the subject-matter of dependent claims.

BRIEF DESCRIPTION OF THE DRAWINGS

Further features and advantages of the present invention can be more readily understood from the following description of its preferred and non-limiting examples of embodiments, wherein.

DETAILED DESCRIPTION OF EMBODIMENTS OF THE INVENTION

Figure 1:
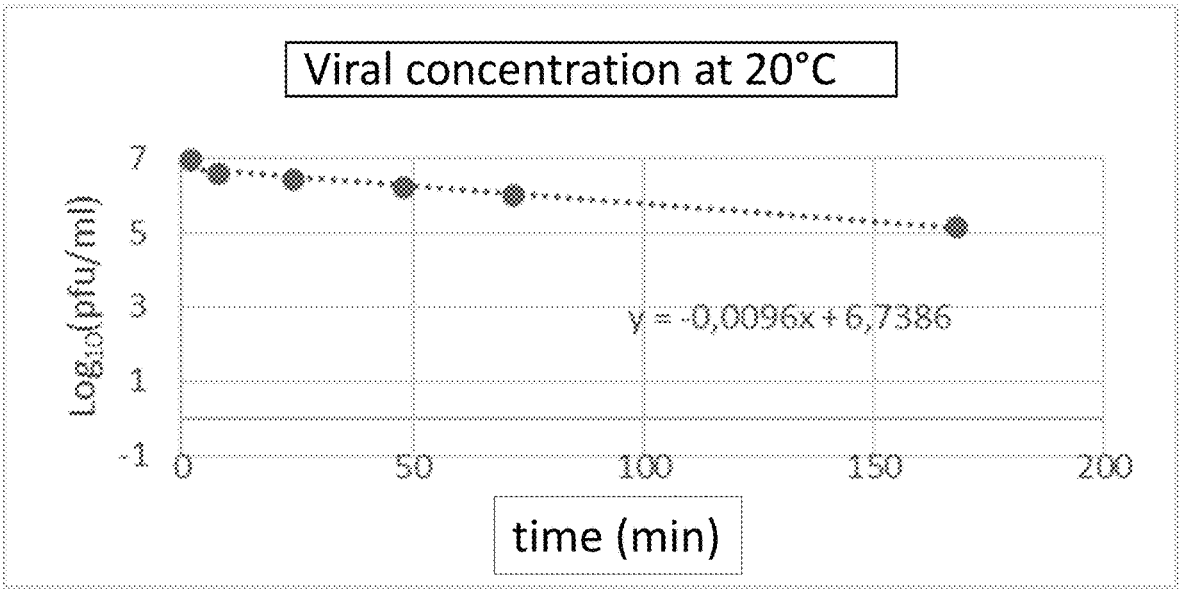
FIGS. 1-3 show the experimental data on abatement tests carried out on the products according to the present invention.

The antiviral and antibacterial composition applied to a fibrous substrate, single- or multilayer, is a composition comprising at least one antiviral agent, in particular at least water-soluble copper metal ions with oxidation state +2 (II) and one or more compounds of the polyethylene glycol (PEG) and polyvinylpyrrolidone (PVP) group.

The composition is preferably applied to a paper substrate, which can be single or multi-ply paper.

The PEG adjuvant functions as an agent to bind the virus or the bacteria to the ions.

Advantageously, the composition comprises polyvinylpyrrolidone (PVP) as a stabilizing agent of the mixture.

The ions, PEG and PVP are applied by means of spray or coating, as described below.

The application method may vary depending on the substrate.

In addition to the antiviral/antibacterial agents, the composition may comprise softeners, perfumes, active agents on the surface of the sheet, dyes and the like.

The composition reduces the viral and bacterial load being deposited there, when contaminated either directly because of the use thereof (e. g. contact with a sick person) or indirectly through an aerosol (e. g. the aerosol produced by the act of coughing or sneezing of a sick person). The treated surface can reduce the viral load by more than two orders of magnitude and the bacterial load by three, decreasing the risk of transmission or retransmission of the pathogen.

The substrate may be pure cellulose or a cellulose derivative (e.g. recycled cellulose), de-inked paper or a non-woven fabric; examples of cellulose or cellulose derivative products that may be used in accordance with the present invention include but are not limited to towels, medical sheets, handkerchiefs and facial tissues.

The paper substrate can be thin tissue paper. The thin tissue paper has a grammage between about 10 g/m$^2$ and 130 g/m$^2$, preferably between about 20 g/m$^2$ and 80 g/m$^2$, and more preferably between about 25 g/m$^2$ and 60 g/m$^2$. Unless otherwise specified, all amounts and grammages are intended as on a dry basis.

The fibrous layer or the fibrous layers that make up the paper substrate may be non-cellulosic or cellulosic, or a combination thereof.

The antiviral and antibacterial composition can be applied uniformly or non-uniformly to the fibrous layer(s), i.e. the amount, distribution pattern of the composition can vary on the surface of the paper.

The antiviral and antibacterial composition can be applied continuously or discontinuously.

The fibers for the manufacture of the paper substrate comprise fibers derived from wood pulp. Other natural fibers such as cotton, jute, etc. can be used.

Synthetic fibers, such as rayon, nylon, polyester, polyethylene, can also be used in combination with natural cellulosic fibers.

Fibers derived from recycled paper, which may contain one or all of the above categories as well as other non-fibrous materials, may also be used.

The preferred water-soluble metal ions used in the present invention comprise copper with oxidation state +2 (II).

Copper (II) can be used alone or in a mixture with other ions, e.g. aluminum.

The composition subject-matter of the present invention comprises 5 to 45% by weight of copper (II) ions, 2 to 20% by weight of PEG and 0.1 to 2% by weight of PVP.

In one embodiment the composition is an aqueous solution of copper sulfate heptahydrate, PEG 8000 and PVP.

PEG 8000 is polyethylene glycol with a molecular weight between 7200-8200.

The composition comprises copper sulfate heptahydrate 5% to 45% by weight, preferably 5% to 25% by weight, PEG 8000 2% to 20% by weight and PVP 0.1% to 2% by weight.

Preferably the composition contains a softener such as quaternary ammonium salts or other surfactant mixtures.

Further features of the composition are:

APPEARANCE: clear

COLOR: blue pH: 3.9

DENSITY: about 1,064 g/cm$^3$.

According to a further embodiment, a composition comprising copper gluconate 5% by weight, 7.5% PEG by weight and 0.5% PVP by weight achieves a viral load reduction by 83.6%.

The amount of antiviral and antibacterial composition that is applied to the tissue is based on the amount of water-soluble metal ion that is added to the tissue based on the dry weight. The amount of antiviral and antibacterial composition on the paper must be optimized to achieve effective inactivation of the viruses and bacteria.

An object of the present invention is also a method for making an antiviral and antibacterial tissue product, said process comprising the steps of:

(a) preparing at least one fibrous layer;

(b) applying an antiviral and antibacterial composition as described above to at least one of the surfaces of said fibrous layer.

The application can take place by spraying the composition through one or more nozzles in the paper product production machine.

The application of the composition can take place during or at the end of the production step of the paper product.

The composition can be applied dissolved in a medium such as a softener, if the medium is compatible.

A spray apparatus or nebulizer can be added to a paper product converting and packaging machine where the finished product is made by cutting, wrapping or folding and packing.

The spray apparatus or nebulizer can be positioned in different places, depending on the layout of the paper product converting and packaging machine.

A rotating disc nebulizer can be used as a nebulizer.

For example, the WEKO nebulizer is known on the market (Weitmann & Konrad GmbH & Co. KG).

The composition is dispensed on the surface of the rotating discs which is deposited on the paper surface.

The amount of composition deposited can be varied by varying the amount dispensed onto the discs in the unit of time.

As described below, surprisingly, the composition subject-matter of the present invention enables the creation of a uniform thin layer that is uniformly distributed on the surface of the paper (FIG. 4), avoiding a droplet distribution (FIGS. 5-8). The application of the composition can take place before the plies are joined.

Advantageously, the composition subject-matter of the present invention has a viscosity value, measured with the 4-mm bore Ford cup according to ASTM D 1200-23 standard (Standard Test Method for Viscosity by Ford Viscosity Cup) between 20 and 100 mPa-s.

With viscosities below 20 mPa-s, it is not possible to control the amount of composition nebulized onto the surfaces to be treated; with viscosity values above 100 mPa-s, the distribution of the composition is not uniform but droplet-like.

The application of the composition can take place by means of a coating unit in a paper product converting and packaging machine or in the paper mill. The coating apparatus can be positioned in different places, depending on the layout of the machine.

The application of the composition can take place by means of a glue group of the paper product converting and packaging machine, if the active substance and the PEG adjuvant are compatible with the glue itself.

It has been demonstrated that the tissue product subject-matter of the present invention can be classified as non-irritating if applied to intact human skin.

In the single-application epicutaneous occlusive test, the 10×10 mm sized paper product, moistened with a drop of liquid paraffin FU and applied for 48 hours to the skin of adult volunteers without dermatitis, not undergoing any medical treatment and having no history of contact allergies, caused neither erythema nor oedema.

The antiviral capacity of the product subject-matter of the present invention was tested rapidly thanks to the use of the Phi X174 phagovirus (BSL1 class organism), in particular with the use of the Phi X-174 bacteriophage DSM 4497 and the target organism thereof *Escherichia coli* DSM 13127, on samples sterilised according to ISO 18184 standard, and requires only one day for the analytical procedure.

The antibacterial capacity of the product subject-matter of the present invention has been tested according to ISO 20743 standard, and requires only one day for the analytical procedure.

The use of the Phi X-174 bacteriophage and the target *Escherichia coli* thereof requires shorter run times due to the speed at which the bacteria grow: the results can be obtained in 16 hours (overnight).

The use of said control test therefore also allows for a quick check of the product's qualities during production before it is placed on the market, together with the assessment of the antibacterial capacity according to ISO 20743 standard.

It is known that a virus can survive on different types of surfaces from hours to days and weeks. In an exploratory test with the Phi X-174 bacteriophage, it was highlighted that it can survive on a pure cellulose surface for up to 168 hours (one week) with a 1.8 log 10 reduction at 20° C. (graph in FIG. 1).

The data obtained are reported in the following table (pfu=plaque-forming units):

| time (h) | Pfu/ml | Log10 | Reduction Log10 |
|---|---|---|---|
| 0 | 8800000 | 6.944483 | — |
| 2 | 9000000 | 6.954243 | 0.01 |
| 8 | 3900000 | 6.591065 | −0.35 |
| 24 | 2580000 | 6.41162 | −0.53 |
| 48 | 1580000 | 6.198657 | −0.74 |
| 72 | 1000000 | 6 | −0.94 |
| 168 | 151250 | 5.179695 | −1.76 |

Figure 2:
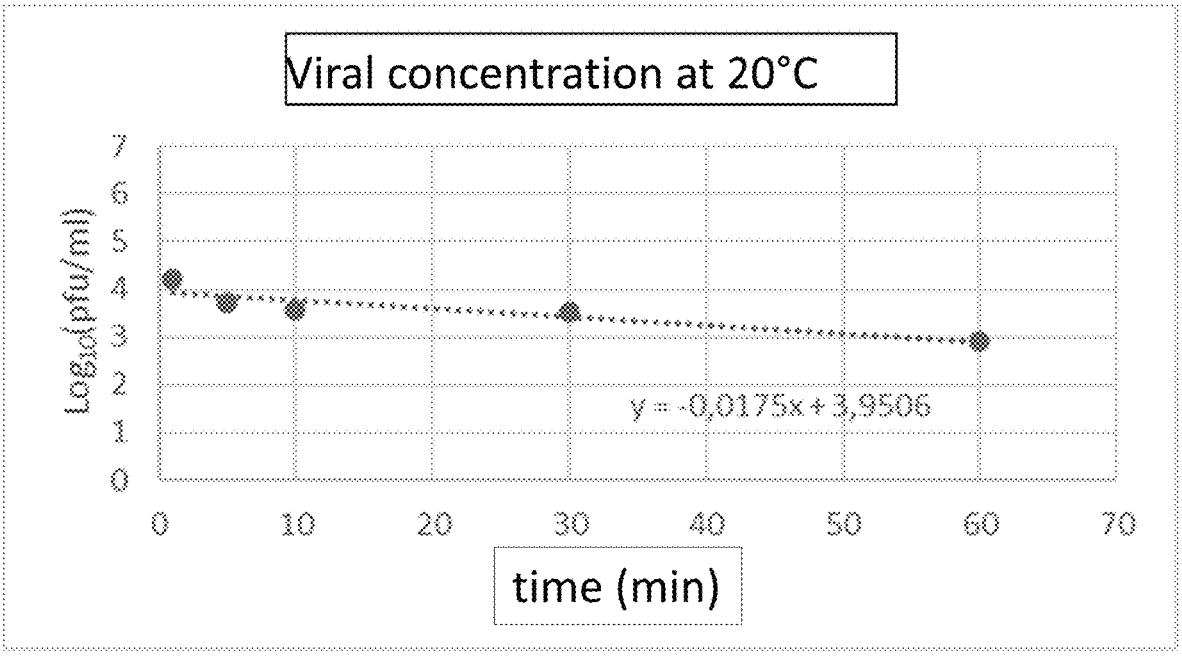

The activity of the Copper ions mixed with PEG was tested against a solution of Phi X-174 with a concentration between $1\times10^5$ and $5\times10^5$, similar to what can be found in an aerosol. The reduction found was 1.5 log 10 in 60 minutes, roughly corresponding to what happens on the untreated product in a much longer time frame (138 hours), as shown in the graph of FIG. 2.

The data obtained are reported in the following table (pfu=plaque-forming units):

| Time (min) | Pfu/ml | Log10 | Reduction Log10 |
|---|---|---|---|
| 0 | 28500 | 4.454845 | — |
| 1 | 16400 | 4.214844 | 0.24 |
| 5 | 5200 | 3.716003 | 0.74 |
| 10 | 3600 | 3.556303 | 0.90 |
| 30 | 3200 | 3.50515 | 0.95 |
| 60 | 800 | 2.90309 | 1.55 |

The following example is given for illustrative purposes only.

In order to test the antiviral capacity, it was used:

Virus: Phi X-174 bacteriophage DSMZ 4497

Target: *Escherichia Coli* DSM-13127

In a typical test, a sample of the handkerchief with the preparation is tested in accordance with ISO 18184 standard with a solution of Phi X-174 in MS from $1\times10^7$ to $5\times10^7$ pfu/ml and a contact time of 2 hours. The time of 2 hours is the minimum contact time specified by ISO 18184 standard. ISO 16604 standard was used to enumerate the virus, which covers the testing of protective clothing against blood and body fluids, and which uses precisely Phi X-174 as the virus model.

The method is a mixture of two standards: the first part used for the test modalities comes from ISO 18184, the second part for virus titration comes from ISO 16604.

400 mg of tissue paper with the active substance and the adjuvant and 400 mg of a control sample made of the same paper as the test sample but without active substance and adjuvant are each sterilized inside a 50 ml Falcon tube at 121° C. for 15 minutes.

Both samples, once cooled, are impregnated at various places with 0.2 ml of a solution containing $1\times10^7$ to $5\times10^7$ PFU/ml of Phi X-174 and incubated at 25° C. for 2 hours.

The viral particles are extracted with 20 ml of MS and then diluted to the power of 10 in MS. Then 0.1 ml of each virus dilution are taken and are placed in contact with 0.1 ml of exponentially growing *Escherichia coli* for 20 minutes at room temperature.

Petri dishes with a double layer of LB agar are made with each diluted sample. Viral plaque count is performed after an overnight incubation at 37° C. Valid samples are those with a plaque count between 20 and 200. The laboratory procedure was validated using twin samples with the Leibniz Institute DSMZ German Collection of Microorganisms and Cell Cultures Gmbh.

Based on this test, the lower reduction limit of the Phi X-174 bacteriophage was set at log 10=1.67 corresponding to a 97.8% abatement of viral load.

Furthermore, according to ISO 18184 standard, tests were carried out for the assessment of the antiviral properties with Feline Calicivirus and influenza virus (H3N2). The treated tissue was also tested with the Human Coronavirus NL63.

The product was found to be active against both the above-mentioned viruses and the coronavirus:

| Virus | Host |
|---|---|
| Feline calicivirus; strain: F-9 (ATCC, VR-782) | CRFK (Crandell-Rees Feline Kidney, ATCC, CCL-94) |
| Influenza A virus (H3N2); strain: A/Hong Kong/8/68 (ATCC, VR-1679) | MDCK (Madin-Darby Canine Kidney, NBL-2, ATCC, CCL-34) |

| Virus | Host |
|---|---|
| Human coronavirus NL63 (BEI Resources, NR-470) | Caco-2 (Human Colon Adenocarcinoma, IZSLER, BS TCL 87) |

Figure 3:
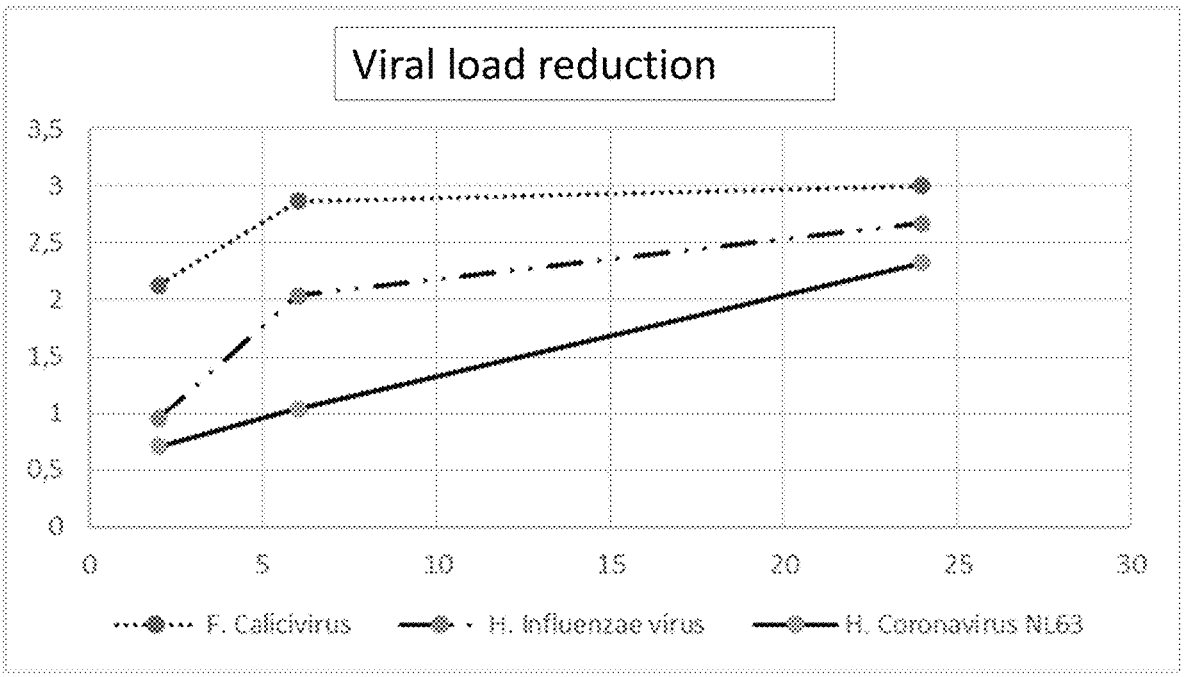

Testing with the organisms reported in ISO 18184 standard gave the following results, as illustrated in FIG. 3:

| Virus | Contact time | Reduction Log10 |
|---|---|---|
| Feline Calicivirus | 2 | 2.13 |
| Human Influenzas virus | 2 | 0.96 |
| Human Coronavirus | 2 | 0.71 |
| Feline Calicivirus | 6 | 2.87 |
| Human Influenzas virus | 6 | 2.04 |
| Human Coronavirus | 6 | 1.04 |
| Feline Calicivirus | 24 | 3 |
| Human Influenzas virus | 24 | 2.67 |
| Human Coronavirus | 24 | 2.33 |

The antibacterial capacity of the preparation was tested according to ISO 20743 standard using the following organisms:

| Bacterium | WDCM Code |
|---|---|
| *Staphylococcus aureus* | 00193 |
| *Klebsiella pneumoniae* | 00192 |

Two treated and two untreated 400 mg paper samples are soaked with 200 μl of a $1\text{-}3\times10^5$ cfu/ml bacterial solution.

A treated and an untreated paper sample are analyzed immediately by extracting the deposited bacteria with a saline solution and quantifying them. The other two samples are incubated at 37° C. for 24 hours and finally analyzed like the previous ones. The inhibition to bacterial growth on the treated product is then extrapolated for comparison with that of the untreated samples. The following results were obtained:

| Bacterium | Reduction (log10) |
|---|---|
| *Staphylococcus aureus* | 2.8 |
| *Klebsiella pneumoniae* | 3.8 |

All samples have been dermatologically tested to verify the skin safety thereof, with positive results as previously mentioned.

The effect of adding polyethylene glycol (PEG) adjuvants, in particular PEG8000, and PVP to the water-soluble copper metal ions with oxidation state +2 (II) in the form of cupric sulfate was also tested.

As can be seen from the table reported below, the addition of both of said adjuvants in the amounts claimed increases the effect of the composition in reducing the viral load:

| cupric sulfate | PEG8000 | PVP | Phi X174 load reduction |
|---|---|---|---|
| 20% | — | — | 68.2% |
| 20% | — | 1% | 72.9% |
| 20% | 10% | — | 94.3% |
| 20% | 10% | 1% | 99.7% |

Surprisingly, a compound with a viscosity that allows optimal application of the product on fibrous surfaces is obtained thanks to the compounds and percentages claimed. In fact, thanks to the claimed formulation, the deposition of the composition on the fibrous substrate is homogeneous, guaranteeing a uniform antiviral and antibacterial effect over the whole treated surface.

FIGS. 4 to 8 show a paper handkerchief subjected to heat treatment at 80° that allows to visually highlight the copper.

Figure 4:
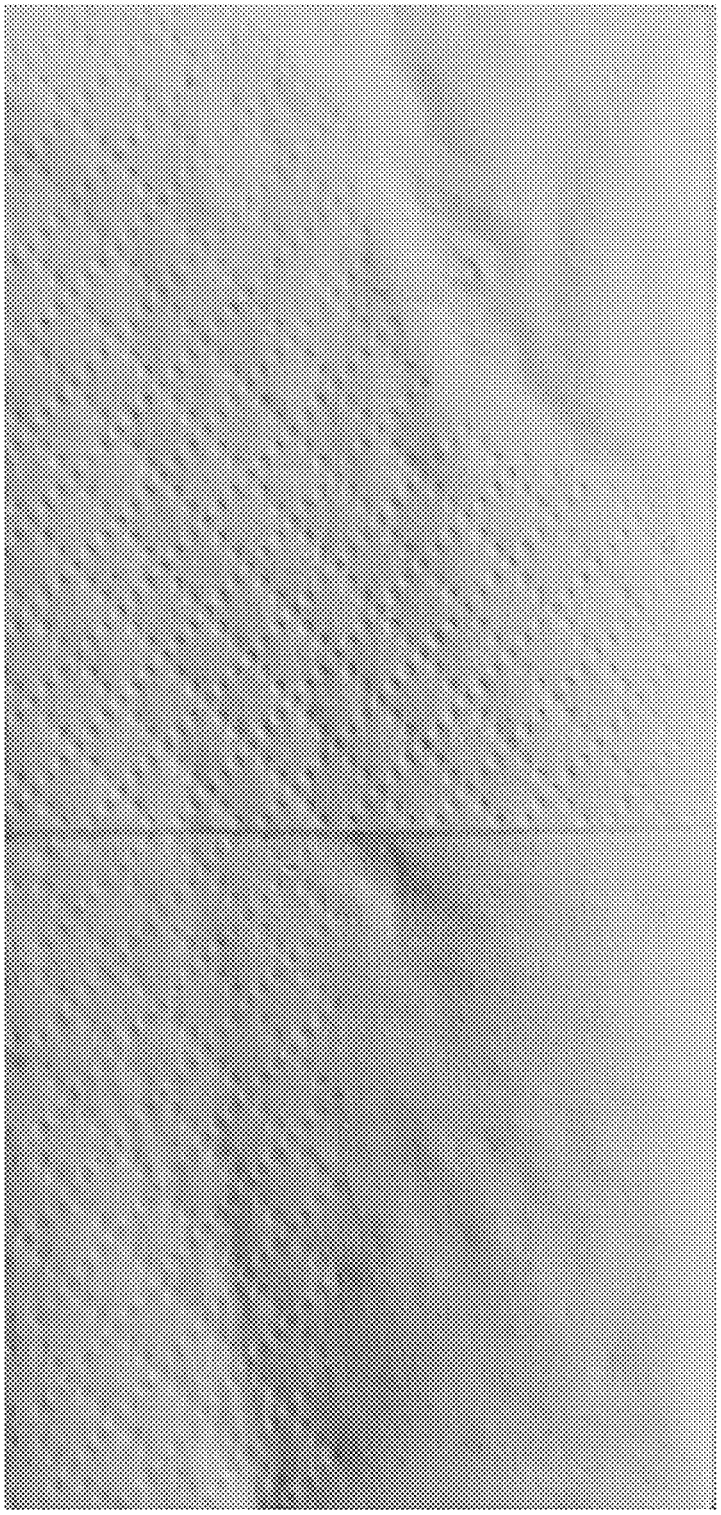
FIG. 4 shows a paper handkerchief treated with a composition comprising cupric sulfate, PEG8000, PVP with percentages by weight according to the present invention.

FIG. 4 shows a paper handkerchief treated with a composition comprising:

20% by weight of cupric sulfate
10% by weight of PEG 8000
1% by weight of PVP.

The same result, i.e. absence of stains demonstrating an even distribution of the composition on the handkerchief, is obtained with the following composition:

15% by weight of cupric sulfate
10% by weight of PEG 8000
1% by weight of PVP, and with a composition comprising:

10% by weight of cupric sulfate
15% by weight of PEG 8000
2% by weight of PVP.

Figure 5:
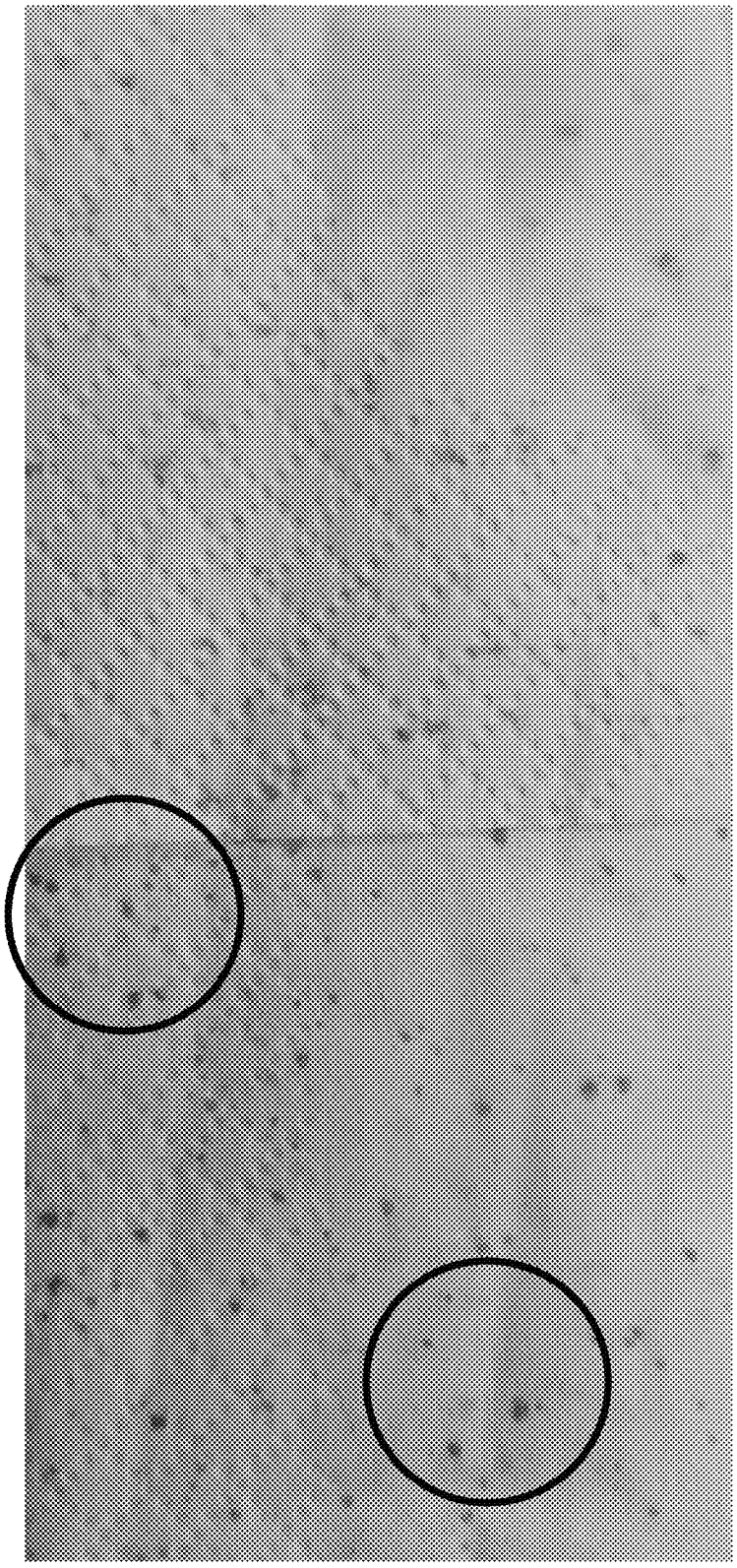
FIGS. 5-8 show paper handkerchiefs treated with a composition comprising cupric sulfate, PEG8000, PVP with percentages by weight not according to the present invention.

FIG. 5 shows a paper handkerchief treated with a composition comprising:

20% by weight of cupric sulfate
25% by weight of PEG 8000
3% by weight of PVP.

Figure 6:
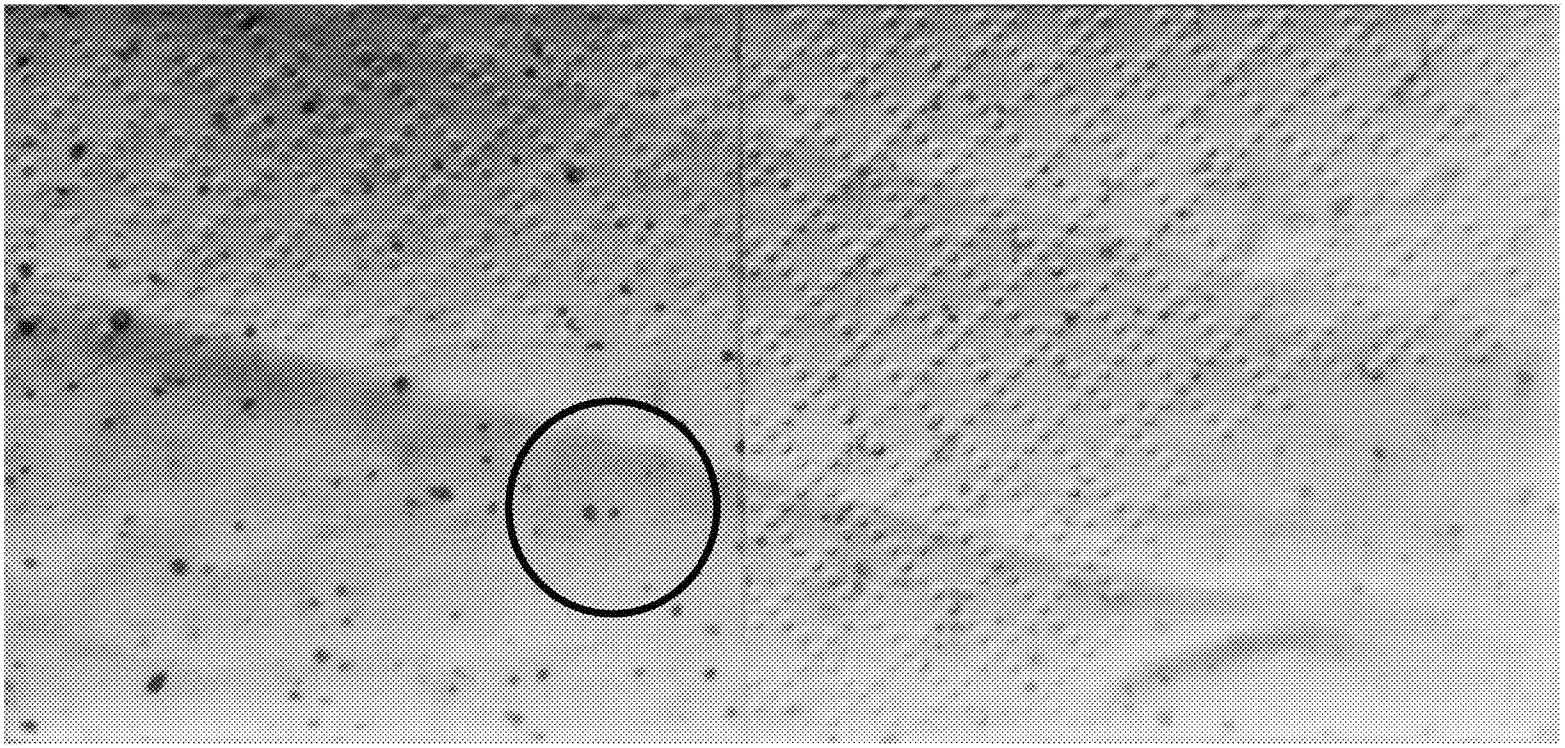

FIG. 6 shows a paper handkerchief treated with a composition comprising:

20% by weight of cupric sulfate
1% by weight of PEG 8000
0.05% by weight of PVP.

Figure 7:
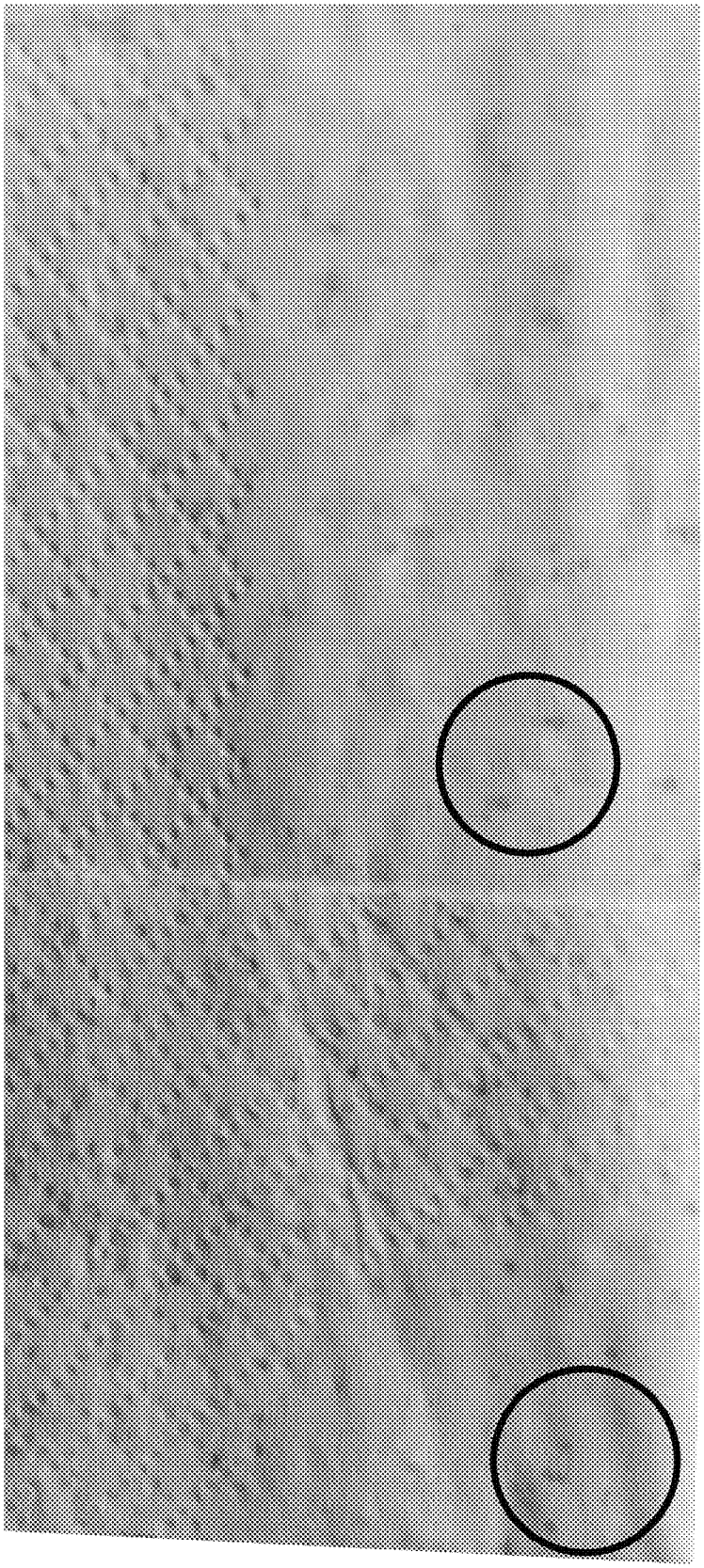

FIG. 7 shows a paper handkerchief treated with a composition comprising:

20% by weight of cupric sulfate
25% by weight of PEG 8000
0.05% by weight of PVP.

Figure 8:
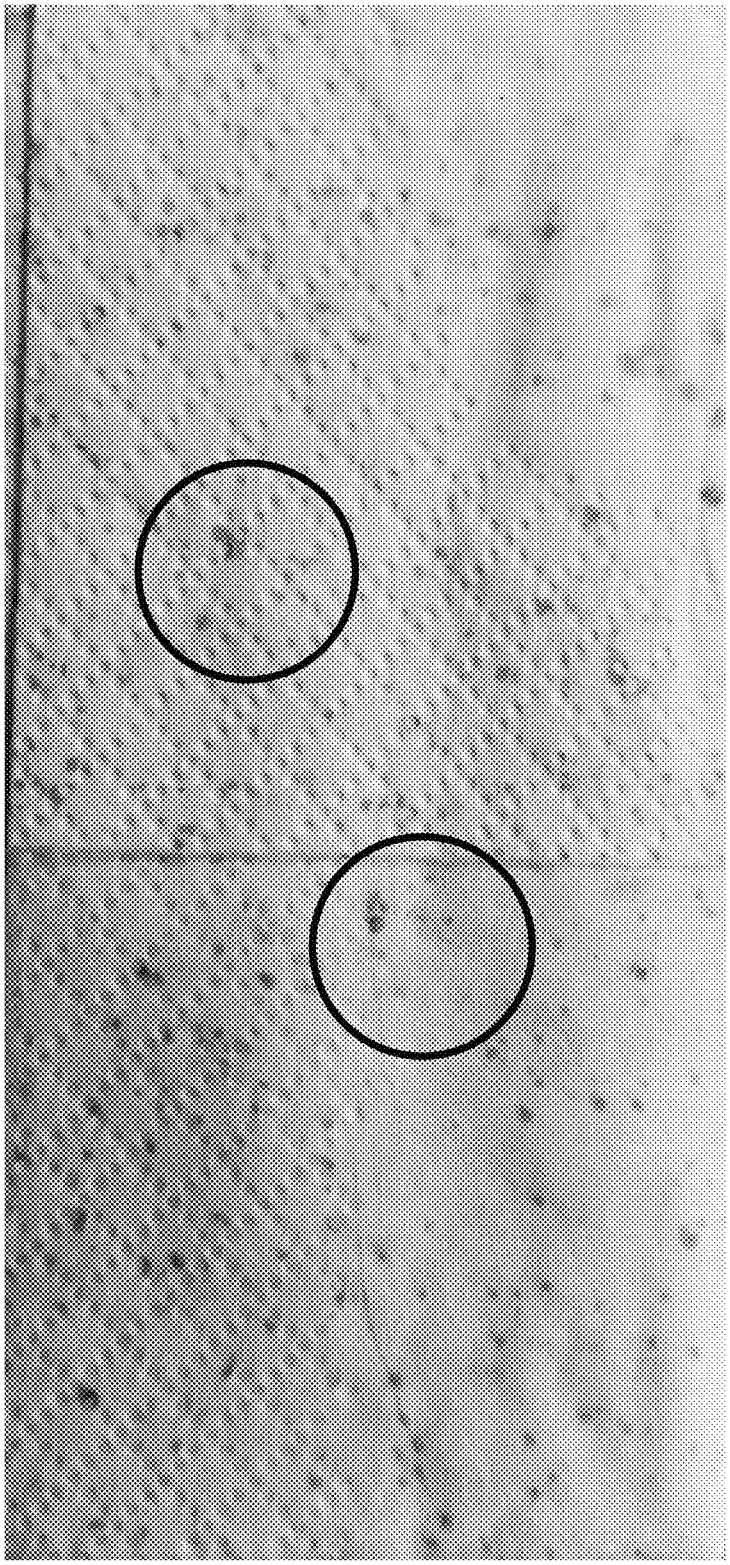

FIG. 8 shows a paper handkerchief treated with a composition comprising:

20% by weight of cupric sulfate
1% by weight of PEG 8000
3% by weight of PVP.

It is evident that by keeping the amount of water-soluble copper metal ions with oxidation state +2 (II) constant, only a composition containing PEG and PVP in the ranges of 2 to 20% and 0.1 to 2%, respectively, allows for a uniform distribution of the composition over the surface to be treated.

A preferred embodiment that allows obtaining a composition with optimal viscosity for distributing it on the layer to be treated comprises:

20% by weight of cupric sulfate
10% by weight of PEG 8000
1% by weight of PVP.

The uniform distribution of the composition is demonstrated by the absence of stains (FIG. 4).

FIGS. 5 to 8 show that a composition with PEG and PVP range outside the claimed ranges does not allow the composition to be uniformly distributed on the fibrous layer and therefore does not allow to obtain a tissue product in which the antiviral and antibacterial properties are uniformly present over the whole fibrous layer.

The stains that are visible in the images in FIGS. 5-8, some of which have been circled in the figures in order to highlight their presence, are evidence of a non-uniform distribution of copper on the treated surface.

According to one embodiment, the at least one layer to be treated is obtained from reels of paper, which, after being freed from the protective film, are unwound in special machines to obtain the plies on which the product is nebulized.

The composition was prepared by mixing PEG 8000 in water by stirring the mixture for at least two hours until the mixture was clear.

While continuing the stirring, PVP is added: the mixture is stirred for at least two hours until the PEG 8000 and PVP mixture is clear. Finally, cupric sulfate was added.

The homogeneous mixture thus obtained was nebulized onto one or more layers that make up the tissue product. In particular, an aerosol containing at least the above-mentioned compounds is sprayed onto the outer surfaces of the handkerchief.

A rotating disc nebulizer was used: the mixture is dispensed onto the surface of the rotating discs, which create a uniform thin layer that is deposited on the surface of one or more plies of the handkerchief.

The amount of mixture deposited on said ply(ies) can be varied by varying the amount of mixture dispensed onto the discs per unit of time.

In order to obtain the distribution of a uniform thin layer of the composition on the ply(ies) and not a droplet distribution, it is necessary to use the compounds in the claimed amounts.

Finally, to obtain the handkerchiefs, the plies are embossed together and cut. The handkerchiefs are then stacked and packed according to known techniques.

The invention claimed is:

1. A composition adapted for manufacturing tissue products with antiviral and antibacterial properties, comprising:

water-soluble copper metal ions with an oxidation state +2 (II);
polyethylene glycol (PEG); and
polyvinylpyrrolidone (PVP),
wherein the composition contains 5% to 45% by weight of copper (II) ions, 2% to 20% by weight of PEG, and 0.1% to 2% by weight of PVP.

2. The composition according to claim 1, wherein the water-soluble copper metal ions are provided as copper sulfate, copper chloride, copper nitrate, copper acetate, copper bromide, copper iodide, or copper gluconate, or a mixture thereof.

3. The composition according to claim 1, wherein the PEG is PEG 8000 having a molecular weight between 7200 and 8200.

4. The composition according to claim 3, wherein the water-soluble copper metal ions are provided as copper sulfate, and wherein the composition comprises 20% by weight of the copper sulfate, 10% by weight of the PEG 8000 and 1% by weight of the PVP.

5. The composition according to claim 1, wherein the water-soluble copper metal ions are provided as copper gluconate, and wherein the composition comprises 5% by weight of the copper gluconate, 7.5% by weight of the PEG, and 0.5% by weight of the PVP.

6. The composition according to claim 1, wherein the composition has a viscosity value, measured with a 4-mm bore Ford cup according to ASTM D 1200-23 standard, between 20 mPa-s and 100 mPa-s.

7. The composition according to claim 1, further comprising at least one softener, perfume, a dye, or an active agent on a surface of a sheet of paper, cellulose, or fabric.

8. A tissue product with antiviral and antibacterial properties comprising:

at least one fibrous layer; and
a composition according to claim 1.

9. The tissue product according to claim 8, wherein the at least one fibrous layer comprises cellulose fibers.

10. A method of making a tissue product with antiviral and antibacterial properties, comprising:

preparing at least one fibrous layer to make the tissue product; and applying a composition according to claim 1 to at least one surface of the at least one fibrous layer during or at an end of the method for making the tissue product.

11. The method according to claim 10, wherein applying the composition comprises nebulizing on at least the surface of the at least one fibrous layer.

12. The method according to claim 11, wherein the nebulizing is performed by a rotating disc nebulizer.

13. The method according to claim 10, wherein the step of applying takes place together with a bonding step of one or more of the at least one fibrous layer.

* * * * *